US005447127A

United States Patent [19]

Lück et al.

[11] Patent Number: 5,447,127

[45] Date of Patent: Sep. 5, 1995

[54] INTERNAL COMBUSTION ENGINE WITH AN OVERHEAD CAMSHAFT

[75] Inventors: Klaus Lück, Hambach; Paul Kehl, Schweinfurt; Detlef Nonnenberg, Obbach, all of Germany

[73] Assignee: Fichtel & Sachs AG, Schweinfurt, Germany

[21] Appl. No.: 227,632

[22] Filed: Apr. 14, 1994

[30] Foreign Application Priority Data

Apr. 16, 1993 [DE] Germany ..... 43 12 497.6

[51] Int. Cl.[6] ..... F01L 1/04; F01M 1/02; F01M 9/10

[52] U.S. Cl. ..... 123/90.31; 123/90.33; 123/196 W; 184/11.5; 184/15.1; 56/12.3; 56/17.5

[58] Field of Search ..... 123/90.27, 90.31, 90.33, 123/90.34, 90.38, 196 W, 196 R; 184/11.1, 11.5, 13.1, 15.1; 56/12.3, 17.5

[56] References Cited

U.S. PATENT DOCUMENTS

| | | | |
|---|---|---|---|
| 4,611,559 | 9/1986 | Sumigawa | 123/196 A |
| 4,727,834 | 3/1988 | Isaka et al. | 123/196 W |
| 4,756,280 | 7/1988 | Tamba et al. | 123/196 W |
| 4,805,565 | 2/1989 | Sato et al. | 123/196 W |
| 4,881,510 | 11/1989 | Etoh et al. | 123/196 W |
| 4,911,119 | 3/1990 | Ohno et al. | 123/196 W |
| 4,974,562 | 12/1990 | Ishii et al. | 123/196 W |
| 4,984,539 | 1/1991 | Shinoda et al. | 123/196 W |
| 5,000,126 | 3/1991 | Isaka et al. | 123/41.65 |
| 5,031,591 | 7/1991 | Shinoda et al. | 123/196 W |
| 5,070,686 | 12/1991 | Isaka et al. | 56/17.5 |
| 5,267,537 | 12/1993 | Suzuki et al. | 123/90.38 |

FOREIGN PATENT DOCUMENTS

| | | |
|---|---|---|
| 0487960 | 6/1992 | European Pat. Off. . |
| 1057822 | 5/1959 | Germany . |
| 4015610 | 11/1990 | Germany . |
| 60-209616 | 10/1985 | Japan . |

*Primary Examiner*—Henry C. Yuen
*Assistant Examiner*—Weilun Lo
*Attorney, Agent, or Firm*—Nils H. Ljungman & Associates

[57] ABSTRACT

A lawn mower has at least one rotary cutting blade and an internal combustion engine for operating the at least one cutting blade, wherein the lawn mower can be operated on a substantially horizontal surface, while inclination of the mower on various surface slopes is also possible, while still maintaining adequate lubrication of the operating parts of the mower.

19 Claims, 6 Drawing Sheets

INTERNAL COMBUSTION ENGINE WITH AN OVERHEAD CAMSHAFT

BACKGROUND OF THE INVENTION

1Field of the Invention

This invention generally relates to a lawn mower having at least one rotary cutting blade and an internal combustion engine for operating the at least one cutting blade. A typical lawn mower is generally designed for operation on a substantially horizontal surface, while inclination of the mower on various surface slopes is also possible. Thus, in what could be considered to be a normal position of the mower, or a horizontal position, the internal combustion engine would generally be considered to be vertical. In this normal position, the engine could essentially be considered to have a vertical crankshaft, at least one overhead camshaft and a transmission disposed between the crankshaft and the at least one camshaft to operate the crankshaft and camshaft in a predetermined synchronization with respect to one another. The transmission can essentially be considered to define a plane of movement, inside a transmission chamber, and perpendicular to the crankshaft axis.

2. Background Information

In general, a lawn mower, such as a walk behind lawn mower, is powered by what could be considered to be a small drive motor, such as a motor having only a single cylinder. Such small drive motors can also be used for operating various other devices, such as, for example, motorized bicycles (mopeds), portable generators, etc. For such small drive motors, a precise control of the valve timings is needed to activate the intake and exhaust valves. For this purpose, overhead camshafts, i.e. camshafts which are mounted so that they can rotate in the cylinder head, are being used to an increasing extent to directly or indirectly activate the intake and exhaust valves located in the cylinder head. A transmission between the camshaft and the crankshaft provides the required drive energy, and also provides the required synchronization of the rotation of the camshaft with the rotation of the crankshaft.

In many applications of an internal combustion engines, the drive shaft driven by the engine is oriented vertically. As discussed above, one example of such an application is a rotary lawn mower. But in this case, the vertical orientation is not always maintained, and there can be a corresponding inclination of the drive shaft as a function of the slope of the ground. With regard to the simplest possible construction and high efficiency, and to eliminate losses due to friction, a direct coupling of the crankshaft of the drive engine to the drive shaft, with the interposition of a simple spur gear, is of great advantage. The crankshaft then also assumes a vertical orientation, or an orientation more or less oriented toward the vertical, depending on the slope of the ground.

The at least one "overhead" camshaft in such a configuration can extend laterally and axially parallel to the axis of the crankshaft. To guarantee reliable operation, in particular at high operating temperatures and high engine speeds, provision must be made for continuous lubrication of the camshaft.

German Patent No. DE 40 15 610 A1 discloses an internal combustion engine of the type described above, on which there is an oil pump in the vicinity of the bottom bearing point of the crankshaft. The oil pump can thus provide positive lubrication, both of the crankshaft connecting rod bearing which is subjected to a particularly severe load, and also of the top bearing point of the overhead camshaft mounted in the cylinder head. For this purpose, the oil pump is connected to a passage in the crankshaft which has both a discharge hole to the connecting rod bearing, and also, in the vicinity of the upper end of the crankshaft, makes a transition into cooling passages of a hollow disk flywheel connected to the crankshaft. The cooling passages in turn empty into a cooling passage which runs parallel to the cylinder axis, inside the hollow cylinder wall which surrounds the piston. This cooling passage has both a discharge point which empties into the crankshaft chamber, and also a discharge point which leads to the upper camshaft bearing. The oil which is discharged from this bearing can flow downward along the camshaft, thereby also lubricating the cam surfaces, as well as the transmission formed by a belt drive between the camshaft and the crankshaft. In this manner, the bottom camshaft bearing can also receive sufficient lubricating oil. The lubricating oil flowing back is collected in a separate, obviously lower-lying oil pan, and is returned to the oil pump.

The positive lubrication of this internal combustion engine requires a complex and expensive construction.

European Patent EP-0 487 960 A1 discloses an engine with an overhead camshaft and a vertically-oriented crankshaft, in which the transmission, consisting of a belt transmission, lies at the upper end of the crankshaft and camshaft. Such a configuration essentially also requires a forced lubrication system for the upper crankshaft bearing and for the upper camshaft bearing. The oil which is transported to the upper bearings can then drip from the upper bearings to lubricate both the cam surfaces and the lower camshaft bearing, and then flow back to an oil reservoir annulus surrounding the crankshaft and housing the oil pump. Because of the upper position of the transmission, the transmission itself does not come into contact with the lubricating oil.

Finally, U.S. Pat. No. 5,000,126 discloses an internal combustion engine for a lawn mower which does not use an overhead camshaft, but instead uses a camshaft mounted in the crankshaft chamber.

OBJECT OF THE INVENTION

The object of the invention is to create, for example, for a lawn mower, an internal combustion engine of the type described above, which has a simple construction and guarantees reliable lubrication of the camshaft under the operating conditions encountered in actual practice.

SUMMARY OF THE INVENTION

The present invention teaches that this object can be achieved if the transmission chamber is designed as an oil reservoir, and if the transmission is located at least adjacent the reservoir, such that in the normal position of the engine, and in any inclined positions of the engine, the portion of the transmission which is currently the lowest can preferably be immersed below the surface of the oil, into the oil within the chamber.

The transmission can thus preferably act as a transport device for the lubricating oil, and can preferably transport the lubricating oil away from the current level of oil in the oil reservoir. On this manner, the transmission can thus preferably provide a uniform distribution of the oil, both in the vicinity of the camshaft and in the vicinity of the crankshaft. If, for example, the engine is temporarily inclined, so that the crankshaft chamber is lower than the camshaft chamber, then the transmission, with its crankshaft-side end, is immersed in the oil, so that the transmission can carry oil out of the crankshaft chamber and transport the oil to the vicinity of the camshaft. Conversely, when the camshaft chamber is lower, oil can preferably be transported by the transmission from the camshaft chamber and into the crankshaft chamber.

Such an oil distribution function of the transmission can preferably even be effective, for example, if the internal combustion engine is suddenly stopped or is suddenly accelerated, so that as a result of the corresponding inertial forces, the oil in the reservoir is momentarily stuck at the corresponding end of the oil reservoir chamber. The transmission can therefore prevent a lack of oil at whichever is the other end of the oil reservoir chamber.

The transmission can preferably be a conventional transmission, such as a spur gear. Due to simple construction and high oil transport capacity, the present invention teaches that a particularly preferred transmission can be an endless chain which runs over a gear wheel connected to the camshaft and a gearwheel connected to the crankshaft. This chain can be a roller chain or an inverted tooth-type chain (ladder chain).

The transmission can just as well also preferably be an endless belt, and preferably a toothed belt, which can run over a pulley connected to the camshaft and over a pulley connected to the crankshaft. The toothed belt can preferably be characterized by a low weight and smooth running, with a precise fit. When either a chain or a belt is used, the configuration of the transmission chamber as an oil reservoir chamber can promote smooth running, since the oil bath for the chain or the belt can contribute to significant improvements in the smoothness and quietness of operation.

To provide for reliable lubrication of the corresponding parts without any additional measures, in the vicinity of the crankshaft-side end and/or of the camshaft-side end of the transmission, there can preferably be at least one deflector for the oil centrifugally thrown off by the transmission, to provide centrifugal or splash lubrication or an oil mist. The splashed oil or oil mist can then preferably, automatically travel even to more distant lubrication points within the engine.

To further improve the lubrication of bearing points, the present invention also provides that, in the vicinity of a bearing point of the crankshaft or of the camshaft, there can preferably be at least one oil duct, to conduct the oil from the oil mist or the oil splash to a corresponding bearing point.

In many cases, in particular for engines which are not subject to extreme stresses or engines which are manufactured particularly economically, the lubrication of the crankshaft by the oil splashed or misted by the transmission is typically sufficient for lubrication of the engine parts. However, in other cases, in particular on engines which might be for professional use, the use of an oil pump can preferably also be provided. An intake for such an oil pump can preferably be connected to the oil reservoir and the outlet of which can preferably be connected to a crankshaft connecting rod bearing. In this manner, there can preferably be a reliable lubrication at the bearing point which is subjected to the highest stresses.

The invention teaches that the outlet of the oil pump can preferably be connected to a passage in the crankshaft with a discharge hole at the connecting rod bearing. The passage can end at the connecting rod bearing, since the camshaft can be lubricated independently by the oil transporting action of the transmission.

Many different structures are conceivable for the oil pump, but one preferred structure could essentially be an oil pump which can be a rubber vane pump that can preferably also be driven by the crankshaft.

In a refinement of the invention, a portion of the oil reservoir can preferably be an annulus which surrounds the crankshaft. The annulus can essentially be manufactured economically, since all that would typically need to be done would be to appropriately modify a portion of the housing to be attached to the crankcase.

If an oil pump was to be used, the invention teaches that the intake of the oil pump can preferably be connected by means of a feed line to the annulus, whereby the feed line can preferably empty into the annulus in the vicinity of the bottom of the annulus. In this case, the feed line can preferably empty into the annulus on the side of the crankshaft axis diametrically opposite the camshaft. This position of the feed line can thus essentially enable the oil pump can to continue to be supplied with oil, even when the engine is tilted by a rather large amount. The location of the feed line on the side of the crankshaft axis away from the camshaft has essentially been provided for those cases where the motor can be inclined rather severely so that the camshaft is higher, but not for severe inclinations in the opposite direction.

On lawn mowers, for example, the camshaft is generally placed forward in the direction of travel, and on steep slopes, of course, allows the lawn mover to travel uphill but not downhill. During travel uphill on a steep slope, the above-discussed position of the intake opening of the oil pump can allow for a reliable lubrication of the bearings with oil under pressure.

So that even with extreme engine inclinations, the oil pump can preferably be prevented from running dry, the present invention teaches that the annulus can be equipped with a cover located underneath the transmission. When the engine is in a corresponding inclined position, the cover can then preferably prevent oil from flowing out of the annulus to the point where the intake opening of the oil pump would be above the surface of the oil.

During operation, to essentially allow sufficient oil to preferably always flow back into the annulus, the invention teaches that the cover can preferably have at least one opening for the passage of oil.

To further essentially provide a sufficient level of oil in the annulus, in which the transmission is always immersed at least partly in the oil, the present invention provides that the at least one oil passage can preferably have a circumferential collar which projects upward. The purpose of the circumferential collar can thereby enable a pool of oil to form on the cover with a depth corresponding to the height of the collar.

For the sake of simplicity, the cover can have a central opening through which the crankshaft can be disposed.

In the above-mentioned case of a steep inclination only toward a higher camshaft, in order to provide that a sufficient volume of oil can be reliably expected to remain in the annulus, the present invention teaches that there can preferably be at least one oil passage opening on the side of the crankshaft axis facing the at least one camshaft.

A cover which is preferably designed as a cover plate can also be economical to manufacture.

To increase the effective oil supply, the present invention also teaches that there can preferably be at least one recess underneath the camshaft.

The particularly preferred use of the internal combustion engine described above is in a lawn mower, although other types of applications are also possible.

In summary, one aspect of the invention resides broadly in a lawn mower comprising blade apparatus, housing apparatus for containing the blade apparatus therewithin, wheel apparatus for supporting the housing apparatus above a surface to be mowed, the lawn mower defining a first plane substantially parallel to the surface to be mowed, handle apparatus extending from the housing apparatus for guiding the housing apparatus along the surface, and an internal combustion engine mounted to the housing apparatus. The internal combustion engine comprising: crankshaft apparatus rotatable about an axis and connected to the blade apparatus for operating the blade apparatus; at least one cylinder, the at least one cylinder having a first end and a second end; the crankshaft apparatus being disposed adjacent the first end of the cylinder; piston apparatus disposed within the at least one cylinder and pivotably connected to the crankshaft apparatus to rotate the crankshaft apparatus; valve apparatus disposed adjacent the second end of the cylinder, the valve apparatus being configured for introducing fuel and air into the at least one cylinder, and exhausting exhaust gases out of the at least one cylinder; camshaft apparatus for operating the valve apparatus; camshaft transmission apparatus connected between the camshaft apparatus and the crankshaft apparatus for operating the camshaft apparatus with the crankshaft apparatus; chamber apparatus for housing the camshaft transmission apparatus, the chamber apparatus comprising oil reservoir apparatus configured for containing a quantity of oil therein; and the chamber apparatus comprising apparatus for maintaining at least a portion of the camshaft transmission apparatus immersed in the oil during operation of the lawn mower with the first plane disposed at an angle between and including substantially horizontal to a substantial angle with respect to horizontal.

Another feature of the invention resides broadly in an internal combustion engine for powering a device such as a lawn mower, the internal combustion engine comprising: crankshaft apparatus rotatable about an axis, the crankshaft apparatus being configured for outputting power generated by the internal combustion engine; at least one cylinder, the at least one cylinder having a first end and a second end; the crankshaft apparatus being disposed adjacent the first end of the cylinder; piston apparatus disposed within the at least one cylinder and pivotably connected to the crankshaft apparatus to rotate the crankshaft apparatus; valve apparatus disposed adjacent the second end of the cylinder, the valve apparatus being configured for introducing fuel and air into the at least one cylinder, and exhausting exhaust gases out of the at least one cylinder; camshaft apparatus disposed adjacent the valve apparatus for operating the valve apparatus; camshaft transmission apparatus connected between the camshaft apparatus and the crankshaft apparatus for operating the camshaft apparatus with the crankshaft apparatus, the camshaft transmission apparatus defining a first plane; the engine being configured for being preferably operated with the first plane principally disposed substantially horizontally; chamber apparatus for housing the camshaft transmission apparatus, the chamber apparatus comprising oil reservoir apparatus configured for containing a quantity of oil therein; and the chamber apparatus comprising apparatus for maintaining at least a portion of the camshaft transmission apparatus immersed in the oil during operation of the engine with the first plane disposed at substantially any angle between and including substantially horizontal to a substantial angle with respect to horizontal.

A further feature of the invention resides broadly in a method of manufacturing and operating a lawn mower comprising: blade apparatus; housing apparatus for containing the blade apparatus therewithin; wheel apparatus for supporting the housing apparatus above a surface to be mowed; the lawn mower defining a first plane substantially parallel to the surface to be mowed; handle apparatus extending from the housing apparatus for guiding the housing apparatus along the surface; an internal combustion engine mounted to the housing apparatus, the internal combustion engine comprising: crankshaft apparatus rotatable about an axis and connected to the blade apparatus for operating the blade apparatus; at least one cylinder, the at least one cylinder having a first end and a second end; the crankshaft apparatus being disposed adjacent the first end of the cylinder; piston apparatus disposed within the at least one cylinder and pivotably connected to the crankshaft apparatus to rotate the crankshaft apparatus; valve apparatus disposed adjacent the second end of the cylinder, the valve apparatus being configured for introducing fuel and air into the at least one cylinder, and exhausting exhaust gases out of the at least one cylinder; camshaft apparatus for operating the valve apparatus; camshaft transmission apparatus connected between the camshaft apparatus and the crankshaft apparatus for operating the camshaft apparatus with the crankshaft apparatus; chamber apparatus for housing the camshaft transmission apparatus, the chamber apparatus comprising oil reservoir apparatus configured for containing a quantity of oil therein; and the chamber apparatus comprising apparatus for maintaining at least a portion of the,camshaft transmission apparatus immersed in the oil during operation of the lawn mower with the first plane disposed at an angle between and including substantially horizontal to a substantial angle with respect to horizontal, the method comprising the steps of: providing an internal combustion engine, housing apparatus, wheel apparatus, handle apparatus and blade apparatus; fastening the wheel apparatus to the housing apparatus; fastening the handle apparatus to the housing apparatus; mounting the internal combustion engine to the housing apparatus; fastening the blade apparatus to crankshaft apparatus of the internal combustion engine; starting the internal combustion engine; rotating the crankshaft to operate the camshaft transmission apparatus; operating the camshaft transmission apparatus to rotate the camshaft; rotating the camshaft to operate the valve apparatus; operating the valve apparatus to exhaust the cylinder apparatus and introduce fuel and air into the cylinder apparatus; igniting the fuel in the cylinder apparatus to form exhaust gases and produce a force for moving the piston apparatus within the cylinder in a direction away from the second end of the cylinder; moving the piston apparatus within the cylinder in a direction away from the second end of the cylinder to rotate the crankshaft to rotate the blade apparatus; moving the lawn mower on the surface to be mowed with the first plane of the lawn mower parallel to the surface to be mowed; varying the angle of the first plane with respect to the horizontal within a range of angles between and including substantially horizontal to a substantial angle with respect to horizontal, during the moving of the lawn mower; and maintaining at least a portion of the camshaft transmission apparatus immersed in the oil during operation of the lawn mower with the first plane disposed at an angle between and including substantially horizontal to a substantial angle with respect to horizontal.

BRIEF DESCRIPTION OF THE DRAWINGS

The invention is explained in greater detail on the basis of a preferred embodiments which are illustrated in the accompanying drawings, in which.

DESCRIPTION OF THE PREFERRED EMBODIMENTS

Figure 1:
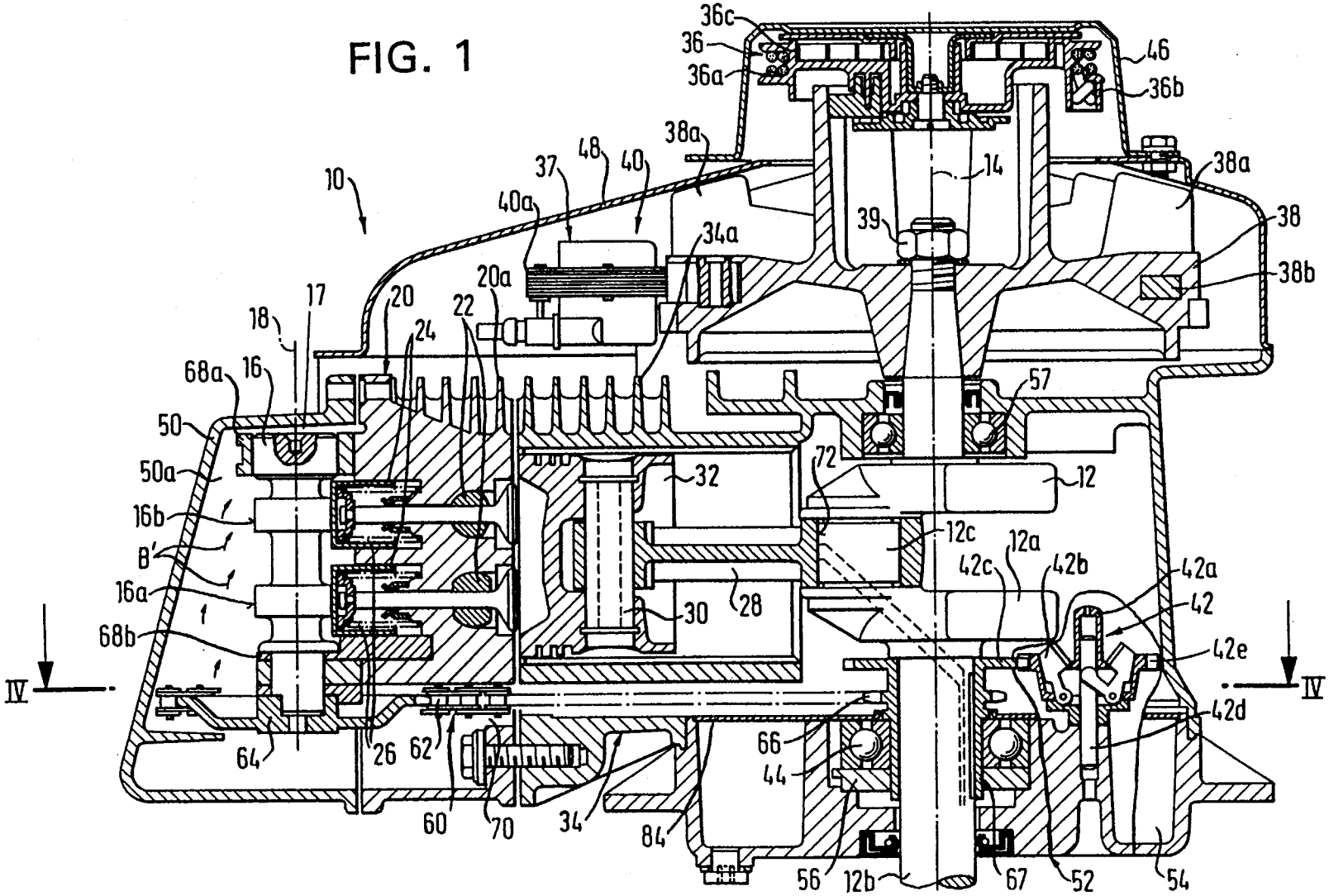
FIG. 1 shows a vertical section along a cylinder axis of an internal combustion engine configured according to the present invention.
Figure 1A:
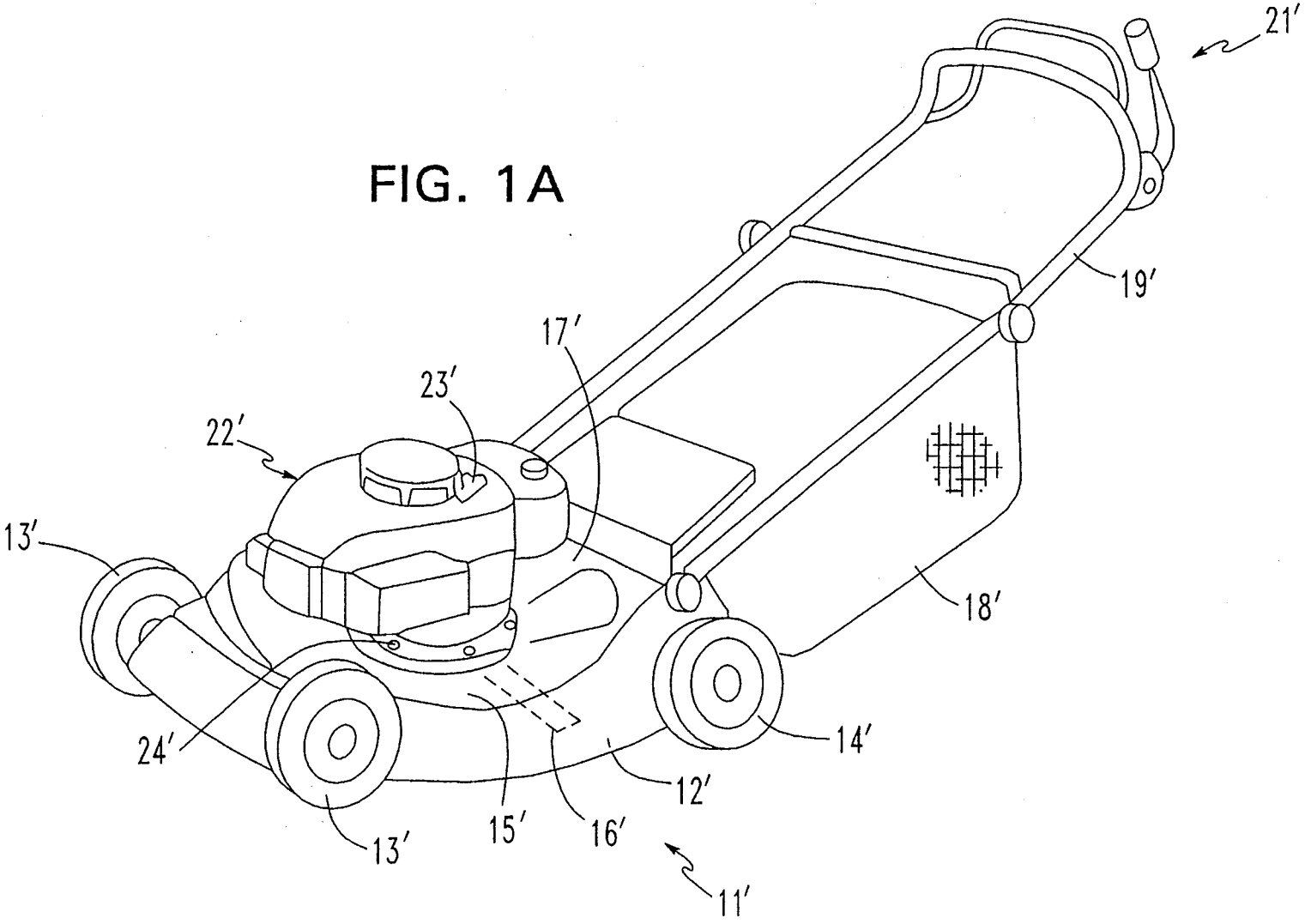
FIG. 1A shows a perspective view of a rotary lawn mower constructed in accordance with an embodiment of the present invention and powered by an internal combustion engine constructed in accordance with an embodiment of the present invention.
Figure 1B:
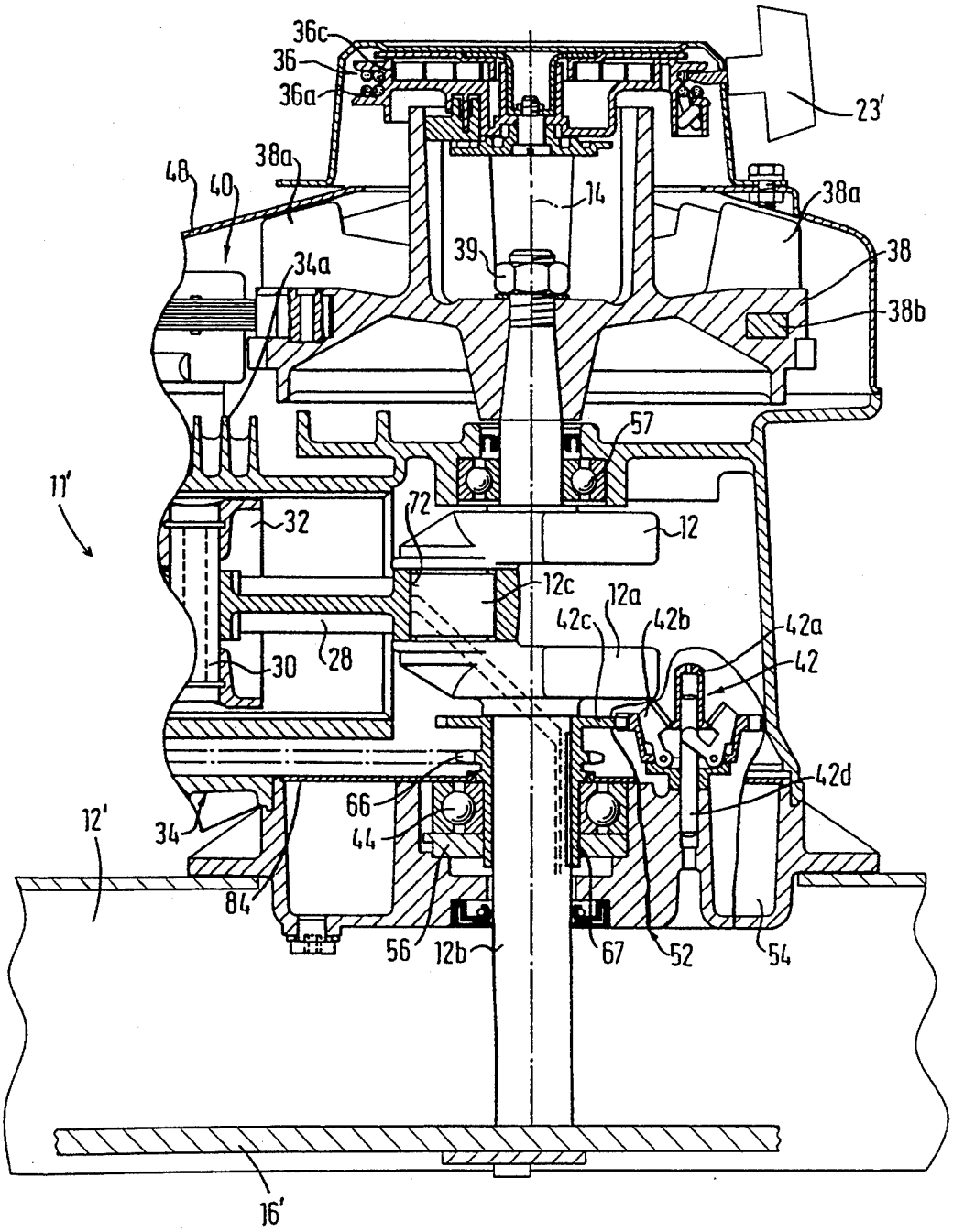
FIG. 1B is a partial cut-away view showing a vertical section of an internal combustion engine in accordance with the present invention.

A lawn mower, such as the walk behind mower 11' depicted in FIGS. 1A and 1B, can typically be driven by a small, lightweight, one-cylinder, four-cycle engine 22'. The lawn mower 11' can preferable have an outer housing 12 that may be formed from any material such as a cast metal or the like and which can preferably be supported at its front end by front wheels 13' and at its rest by rear wheels 14'. If desired, the front wheels 13' or the rear wheels 14' may be driven in an appropriate manner (not shown) so as to provide a self-propelled lawn mower.

The housing 12' preferably can have a scroll portion 15' that can have an upper wall that can be generally helical in configuration and which can preferably extend from a low portion that is disposed immediately adjacent the upper end of a cutting blade 16' to a raised discharge portion 17' which can preferably be disposed immediately adjacent a rearwardly facing discharge chute. A handle 19' preferably extends rearwardly from the main body portion 12' and overlies and supports the grass catcher bag 18' in a known manner. A throttle control 21' can preferably be disposed on the rear portion of the handle 19' for controlling the speed of the mower.

An internal combustion engine, indicated generally by the reference numeral 22', which could have a pull starter 23', can preferably be supported on the main housing 12' of the lawn mower 11' in an appropriate manner by apparatus of mounting bolts 24'. One embodiment of an internal combustion engine which can be used on a lawn mower, as well as other similar devices is depicted in FIG. 1. Modern engines of this type can typically have a valve control with an overhead camshaft, i.e. a camshaft 16 mounted in the cylinder head, which camshaft 16 activates the intake and exhaust valves 22.

Such a configuration of an internal combustion engine 10, as illustrated schematically in FIG. 1 can preferably have a crankshaft 12, the crankshaft axis 14 of which, when the motor is in a normal position, can preferably be oriented substantially vertically. A camshaft 16 with an axis 18 substantially parallel to the crankshaft axis 14 can be mounted so that the camshaft 16 can rotate in a cylinder head 20, and preferably directly activate the valves 22 mounted in the head 20. In the illustrated example, the activation of the valves 22 by means of the camshaft 16 can preferably take place by means of cup tappets 24, each of which cup tappets 24 can preferably enclose a valve spring 26.

With regard to the general design of the internal combustion engine 10, it should also be noted that the crankshaft can preferably be connected by means of a connecting rod 28 and a piston pin 30 with a cylinder 32. The cylinder 32 can preferably be mounted so that the cylinder can move back and forth in a cylinder crankcase 34. As shown, the illustrated engine 10 can be air-cooled, for which there can preferably be corresponding cooling fins **34*a* and 20*a* on the cylinder crankcase 34 and on the cylinder head 20**.

The oil lubrication system described in greater detail below can also be used on liquid-cooled engines, however.

Other components of the internal combustion engine 10, as illustrated in FIG. 1, can preferably include, for example, a cable pull starter 36 as well as a magneto ignition unit 37. The cable starter 36 can preferably have a conventional structure which is well known and not discussed in great detail herebelow. The cable pull starter 36 can preferably comprise a cable **36*a* which can preferably be wound onto a cable pulley 36*b*, and an inner end of the cable 36*a* can be fastened to this pulley 36*b*. The other end of the cable can preferably have a handle, such as the handle 23' shown in FIG. 1B. A cable tension spring 36*c* can be included to apply tension to the cable pulley 36*b* to wind up the cable 36*a*. By means of a freewheel (not shown), the cable pulley 36*b* can preferably be connected to a magnet wheel, or rotor 38, which magnet wheel 38 can, in turn, preferably be permanently fastened (i.e. by means of nut 39) to the upper end of the crankshaft 12**.

The magnet wheel 38 can also preferably be designed with cooling fins **38*a*. The magnet wheel 38 can also preferably have at least one permanent magnet 38*b* as part of the magneto ignition unit 37. Each time the permanent magnet 38*b* passes an exciter unit, or dynamo 40, shown in FIG. 1 to the left of the magnet wheel 38, the necessary ignition voltage for a spark plug (not shown) can be generated in the dynamo 40 to thereby ignite the spark plug. To amplify the induction effect of the magnet 38*b*, the ignition unit 37 can also have armature core disks 40*a***.

As shown, on the bottom right in FIG. 1, the engine 10 can also preferably have a conventional flyweight governor 42 which can preferably be engaged with a throttle valve (not shown) to regulate the speed of operation of the engine. A support piece 42*a* for fly weights 42*b* can preferably have a circumferential toothing 42*e*. These teeth 42*e* can preferably be engaged in a gear wheel 42*c*, which can preferably be permanently fastened, between a bottom crank arm 12*a* of the crankshaft 12 and a bottom crankshaft bearing 44, to a lower shaft journal 12*b* of the crankshaft 12. An activation element 42*d*, which can be connected in turn by means not shown, to the throttle valve can be axially adjusted to adjust the fly weights 42*b*, and thereby alter the rotation of the flyweight governor and the speed of operation of the engine.

As shown in FIG. 1, a number of covers can preferably be provided to protect parts of the engine 10. A first cover 46 can be provided over the valve pull starter 36. The cable 36*a* of the pull starter 36 can then be pulled outward through the cover 46. An additional cover 48 can cover the magneto ignition unit 37 and the magnet wheel 38. Also, a cylinder head cover 50 can be provided to cover the camshaft 16.

The bottom crankshaft bearing 44 and the flyweight governor 42 can preferably be located in a separate housing 52, which can preferably be attached to the cylinder crankcase housing 34. The housing 52 can also preferably enclose an annulus 54 which can serve as part of the oil lubrication system described further below. In one version of the engine, the housing 52 can also enclose an oil pump 56, which, for example, can be in the form of a vane pump. An upper crankshaft bearing 57, on the other hand, can preferably be inserted directly into the cylinder crankcase housing 34.

In order to provide synchronized operation of the valves 22 and the piston cylinder 32, the cam shaft 16 can preferably be driven in synchronization with the rotation of the crankshaft 12 by means of a transmission 60. This transmission 60 can simultaneously perform the function of distributing the lubricating oil to provide sufficient lubrication of the engine 10. As shown in the illustrated example, the transmission 60 can possibly be formed by an endless chain 62 (roller chain or inverted tooth type chain), which Chain 62 can preferably run over both a gear wheel 64 fastened to the lower end of the camshaft 16 and over a gear wheel 66 fastened torsionally to the shaft journal 12*b* of the crankshaft 12. Depending on the design of the engine, tension can be applied to the chain 62 by a tensioning device (not shown). Under certain circumstances, this tension device can be omitted in a simple engine. The gear wheel 66 can preferably be pushed onto the shaft journal 12*b* as a joint component with the above-mentioned gear wheel 42*c*, and, with the shaft journal 12*b* can form a torsionally connected gear wheel bushing 67. Instead of the chain 62, an endless belt, in particular a toothed belt, can also be used, which toothed belt could run over corresponding pulleys on the camshaft 16 and crankshaft 12 instead of the gear wheels 64 and 66.

To provide sufficient engine lubrication when the crankshaft axis 14 is exactly vertical, and when the engine is in inclined positions, that is, with the crankshaft axis 14 at an angle from the vertical, the transmission chamber 70, housing the transmission 60 inside the engine 10, can preferably be simultaneously designed as an oil reservoir. The chain 62 (or the belt, in the case of a belt drive) can then preferably always be immersed in the oil, both in the normal position of the engine with an exactly vertical crankshaft axis 14, and also in corresponding inclined positions. With the transmission 60 essentially always immersed in oil, the transmission 60 can transport the oil out of the oil reservoir, i.e. into an area which temporarily has no oil.

Figure 2:
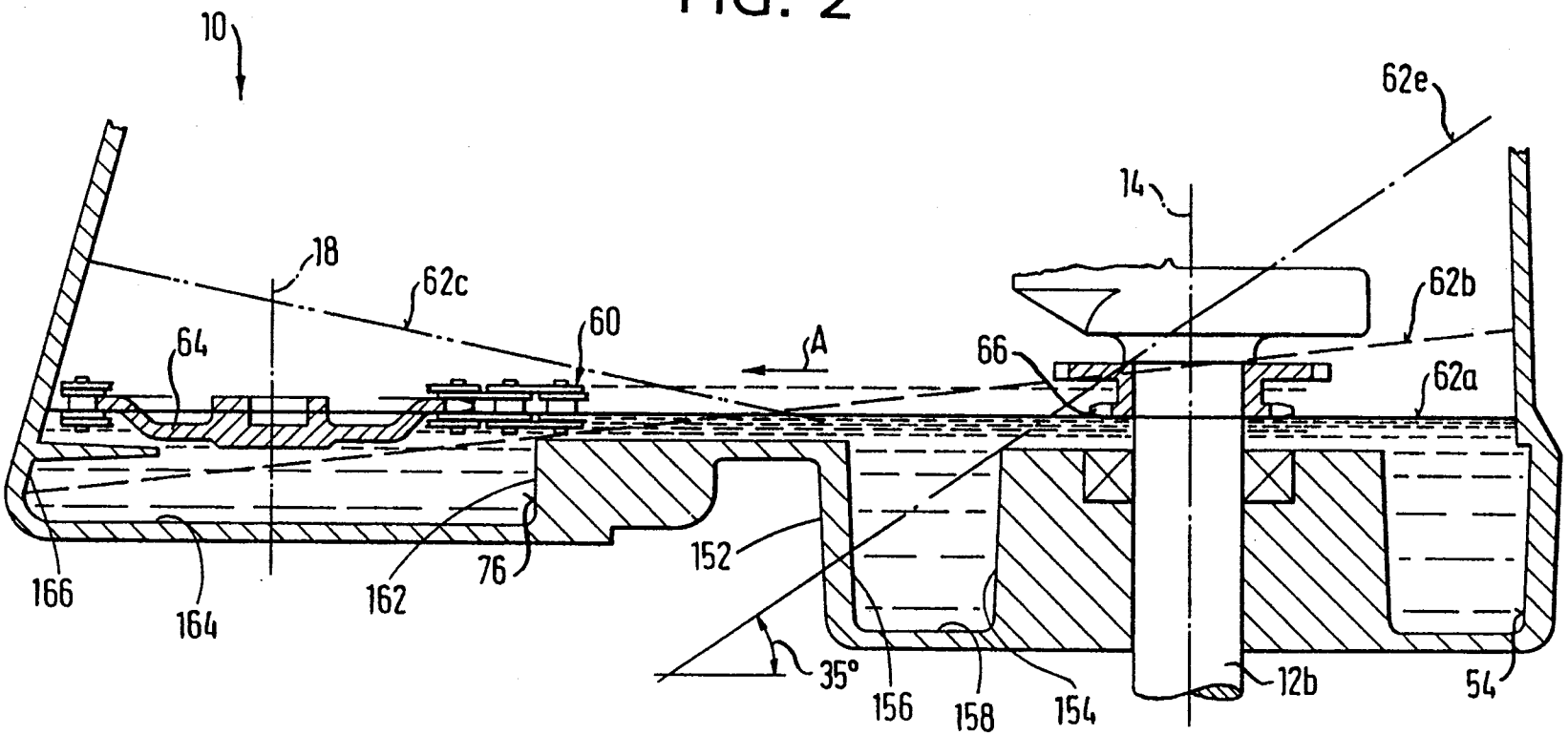
FIG. 2 shows a further simplified vertical section of a version of the internal combustion engine illustrated in FIG. 1 without the oil pump, whereby several oil levels are indicated for different inclinations of the engine.

Some situation with regard to inclination of the engine are illustrated in FIG. 2. As shown, the solid line 62*a* illustrates an oil level when the crankshaft axis 14 is oriented essentially vertically (i.e. perpendicular to a horizontal surface on which a mower operates). The level 62*a* is oriented so that the chain 60 and the gear wheels 64 and 66 are immersed at least partly in the lubricating oil. If the engine is tilted, e.g. because the lawn mower in which it is installed is travelling on a slope, then the oil level might change to the position as illustrated by 62*b*, that is, at a slight inclination to the transmission 60. In what could be considered a conventional design, such an inclination would occur in going up a hill, wherein the cylinder 32 of the internal combustion engine 10 would be pointing forward in the direction of travel.

FIG. 2 shows that, under such uphill conditions, the rear gear wheel 66, to the right in FIG. 2, would typically be fully immersed in the lubricating oil. Consequently, the chain 60 could transport lubricating oil forward (Arrow A) to the front gear wheel 64: There, the oil can be centrifugally thrown radially outward (Arrows B in FIG. 4) from the axis 18, on account of the centrifugal force generated when the chain 62 travels around the gear wheel 64. This centrifugal throwing of the oil can then splash oil against deflector surfaces 19 and cause an oil mist to form. These splashes or oil mist can then spread in the interior 50*a* of the cylinder head cover 50 (Arrows B′ in FIG. 1), along passages, such as passage 17, with the result that both an upper and a lower bearing point 68*a* and 68*b* of the camshaft on the cylinder head can preferably be supplied with sufficient lubricating oil. Likewise, the cam surfaces 16*a* and 16*b* of the camshaft 16 in contact with the cup tappets 24 can also be supplied with lubricating oil. The cup tappets 24 themselves can also receive sufficient lubricating oil, as necessary, inside their respective guide holes in the cylinder head 20.

If, on the other hand, the motor is inclined in the opposite direction (i.e. travelling downhill), an oil level 62*c*, as indicated in FIG. 2 by a dash-dot-dot line, can result. Under these conditions, therefore, the front gear wheel 64 would typically be immersed in the lubricating oil. Consequently, the chain 62 with its chain section 62*a*″ (FIG. 4) running back to the gear wheel 66 can transport lubricating oil into the crankshaft chamber (in the direction of Arrow C in FIG. 4). Thus, in the vicinity of the chain 62 running around the gear wheel 66, oil can be centrifugally thrown radially outward (Arrows D in FIG. 4), and oil splashes can form. The oil splashes which are formed, as well as the resulting oil mist, can then provide proper lubrication both for the crankshaft bearings 44 and 57, and also in general of a connecting rod bearing 72 between the connecting rod 28 and the journals 12*c* of the crankshaft 12.

Figure 4:
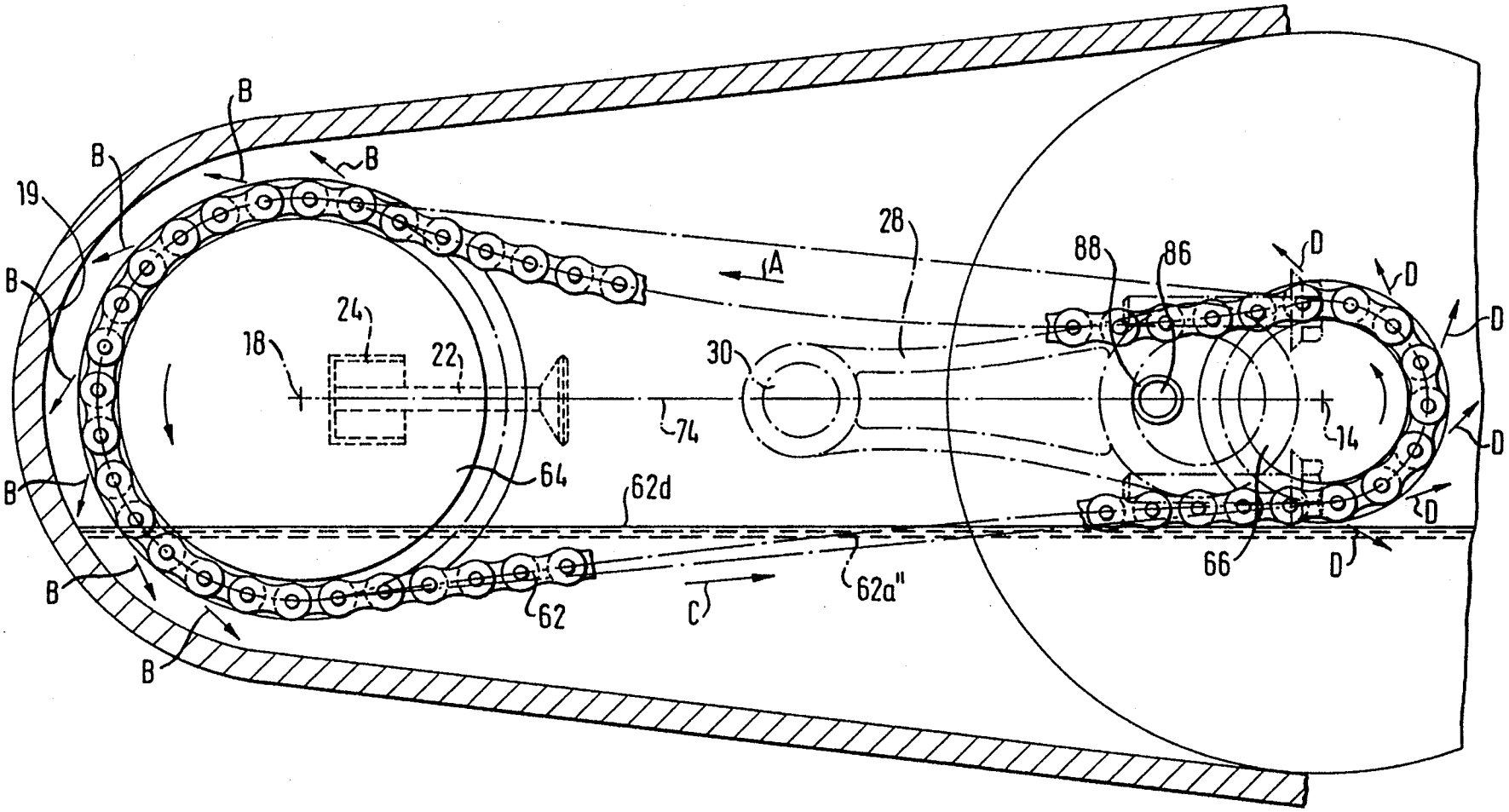
FIG. 4 shows a plan view of the transmission of the internal combustion engine illustrated in FIGS. 1 and 3 (cross section along Line IV—IV in FIGS. 1 and 3).

The oil transporting action of the transmission 60, which provides the lubrication, from the pools of lubricating oil to distant areas of the engine, can also be present when the motor assumes a lateral inclination, i.e. an inclination around a horizontal pivoting axis 74, which lies in a plane containing the two axes 14 or 18, as would typically occur when mowing laterally across a sloped surface. FIG. 4 indicates an oil level 62*d* which could result from a corresponding lateral inclination of the engine 10 (seen in the direction parallel to the axes 14 and 16). As shown in FIG. 4, at least the front gear wheel 64 may then be immersed in the oil, so that there is a transporting action in direction C, with oil splashes centrifugally thrown in the direction of the Arrows D and B when the chain circulates around the rear gear wheel 66 and the front gear wheel 64, respectively. The oil splashes or the oil mist can then provide sufficient lubrication of all the bearing points.

So that the transmission 60 of the present invention can essentially always run at least partly through standing lubricating oil, even in the above mentioned tilted positions, a certain supply of oil would be necessary within the oil reservoir 70. To hold the oil, there can preferably be the above mentioned annulus 54 which surrounds the shaft journal 12*b*. In addition, in the vicinity of the front gear wheel 64, there can preferably be a recess 76 to form a corresponding oil well to hold an additional supply of oil. The correspondingly large oil supply thus provides that, even in relatively extreme inclined positions, the transmission 60 can essentially always be at least partly immersed in oil in the oil reservoir 70. FIG. 2 shows, by means of a dash-dot line, an oil level 62*e* which is formed when the motor assumes what might be deemed an extreme inclination of 35 degrees (travelling uphill). Under such extreme conditions, the rear gear wheel 66 can remain immersed in the oil in the oil reservoir 70. The limit angle for downhill travel, on the other hand, can be lower under some conditions, since for safety reasons the vehicle should not be allowed to travel down excessively steep slopes, as such excessively steep slopes can pose a danger to the operator.

The constant, at least partial immersion of the transmission in the oil reservoir can also preferably have the advantage of reducing the noise generated during operation.

The size of the oil reservoir can be determined by the fact that when the engine is inclined around the above mentioned horizontal axis 74, even by more than 90 degrees, the oil level 62*d* remains below the valves 22 and cup tappets 24, so that a penetration of hot and low-viscosity oil over the valve guides and the intake valve into the combustion chamber or into the outlet duct and the muffler can be prevented. Such a lateral engine inclination might be necessary when, for example, the blades are cleaned after the lawn mower has been used, or when maintenance and repairs must be performed on the cutting tool (rotary blades).

In one possible embodiment of an internal combustion engine, if the engine were built such that its overall length was about 28 cm, the annulus 54 could possibly have a depth of about 3.5 cm with an inner circumference of about 3.5 cm and an outer circumference of about 6 cm. As such, the volume of the annulus could then be about 260 $cm^3$. In addition, the front reservoir 76 could have a depth of about 1.5 cm, with a length (front to back) of about 9.25 cm and an average width of possibly about 8.5 cm, so that the volume of the front reservoir might be about 120 $cm^3$. Further, as described above, and as shown in FIG. 2, the chamber can also be designed such that there is a layer of 0.5 cm of oil, which in a chamber having an average length of about 25 cm, and an average width of about 10.5 cm, could thus have a volume of about 130 $cm^3$. Thus, in total, the chamber could preferably be designed to contain possibly about 510 $cm^3$ of oil.

The above values with regard to the length, width, and depth of the chambers are meant as exemplary only, and one of ordinary skill in the art of small engine design would be able to readily make variations thereon for other possible engine sizes, while staying within the scope of the present invention. For example, if an engine larger than about 28 cm (as described immediately hereabove), were to be constructed in accordance with the teachings of the present invention, the lengths, widths, depths and volumes for the larger engine could essentially be proportionally larger than the lengths, widths, depths and volumes as described above. Likewise, if an engine smaller than about 28 cm was to be built in accordance with the present invention, the lengths, widths, depths and volumes for the smaller engine could essentially be proportionally smaller than the lengths, widths, depths and volumes as described above.

In determining the configuration of the chambers needed for a small engine built in accordance with the present invention, there can be several other factors which possibly could need to be considered. For example, if in one possible embodiment of the present invention, an engine was to be mounted on a device, for example, on a lawn mower, which was designed for use on steeper surfaces, that is, at an angle of possibly greater than 35° in relation to the horizontal, the reservoirs 76 and 54 should possibly have a deeper configuration wherein more oil can then be contained therein while operating at the steeping angles. In this manner, the oil levels, i.e. level 62*c* could then possibly be kept away from the valve tappets 24 so that excess oil did not penetrate into the valve openings, while the oil level 62*e* could possibly be kept away from the crankshaft portion 12*c* to thereby prevent excessive frothing of the oil which could be caused by the rapid churning of the crankshaft portion 12*c* as it revolved about the axis 14.

Similarly, if a possible alternative embodiment of an engine was designed for use only on a substantially horizontal surface, or alternatively, at possibly small angles, i.e. up to possibly about 10° with respect to the horizontal, it may be possible to completely eliminate the oil reservoirs 76 and 54, or alternatively substantially reduce the sizes thereof, as there would be a substantially reduced likelihood of oil penetration into the valves 22 or into the vicinity of the crankshaft portion 12*c*.

In essence, depending on the range of angles for which an engine is designed to be used, it is submitted that one would readily be able to determine, without undue experimentation, the appropriate configuration and sizes of any oil reservoirs needed for alternative embodiments of engines so that lubrication of the engine parts could be achieved in accordance with the present invention.

If in building an engine, it was determined that a larger reservoir 54 was needed, in possible embodiments of the present invention, it would essentially be possible to increase the size of the reservoir 54 by moving the two side walls 154 and 156 away from one another, or increase the depth to surface 158. In this regard, returning to the example of the 28 cm engine as discussed above, if it was desirable to maintain the external circumference of about 13.5 cm as defined by surface 152 essentially the same for various engines, the annulus 54 could be enlarged by moving the inner surface 154 of the annulus towards the crankshaft journal 12*b* so that the inner radius was reduced to possibly about 3.0 cm, about 2.5 cm, or even about 2 cm. Alternatively, or in addition to the moving of the inner surface 154, the base surface 158 could be moved downwardly to increase the depth of the annulus to a depth of possibly about 4.0 cm, about 4.5 cm, about 5.0 cm, about 5.5 cm, etc.

On the other hand, in other possible embodiments, if the size of the annulus 54 was to be reduced, while, for example, maintaining the external circumference of the surface 152 at about 13.5 cm, the surfaces 154 and 156 could be moved towards one another, or the base 158 could be raised to decrease the depth. In this regard, the width of about 2.5 cm, as discussed above, could possibly be reduced to about 2.0 cm, or possibly about 1.5 cm. Alternatively, or in addition to the reduction in the width of the annulus, the depth could possibly be decreased to about 3.0 cm, or possibly about 2.5 cm, or possibly about 2.0 cm, or possibly about 1.5 cm, etc.

In a similar manner, in possible alternative embodiments, the dimensions of the front reservoir 76 could also be reduced or enlarged by reconfiguring the wall parts 162, 164 and 166. For example, the surfaces of wall parts 162 and 164 could be moved towards one another to reduce the length of the reservoir from about 9.25 cm (as discussed above) to possibly about 9.0 cm, about 8.5 cm, about 8.0 cm, about 7.5 cm, etc., or, on the other hand, to enlarge the reservoir 76, the length could possibly be increased to about 9.5 cm, about 10 cm, about 10.5 cm, about 11 cm, etc. Alternatively, or in addition to reconfiguring the walls 162 and 166, the base 164 could also possibly raised or lowered to respectively, decrease or increase, the depth of the reservoir 76. In this regard, the depth could possibly be reduced to about 1.0 cm, or about 0.5 cm, etc, while the depth could possibly also be increased to about 2.0 cm, about 2.5 cm, about 3.0 cm, or about 3.5 cm, etc.

Figure 3:
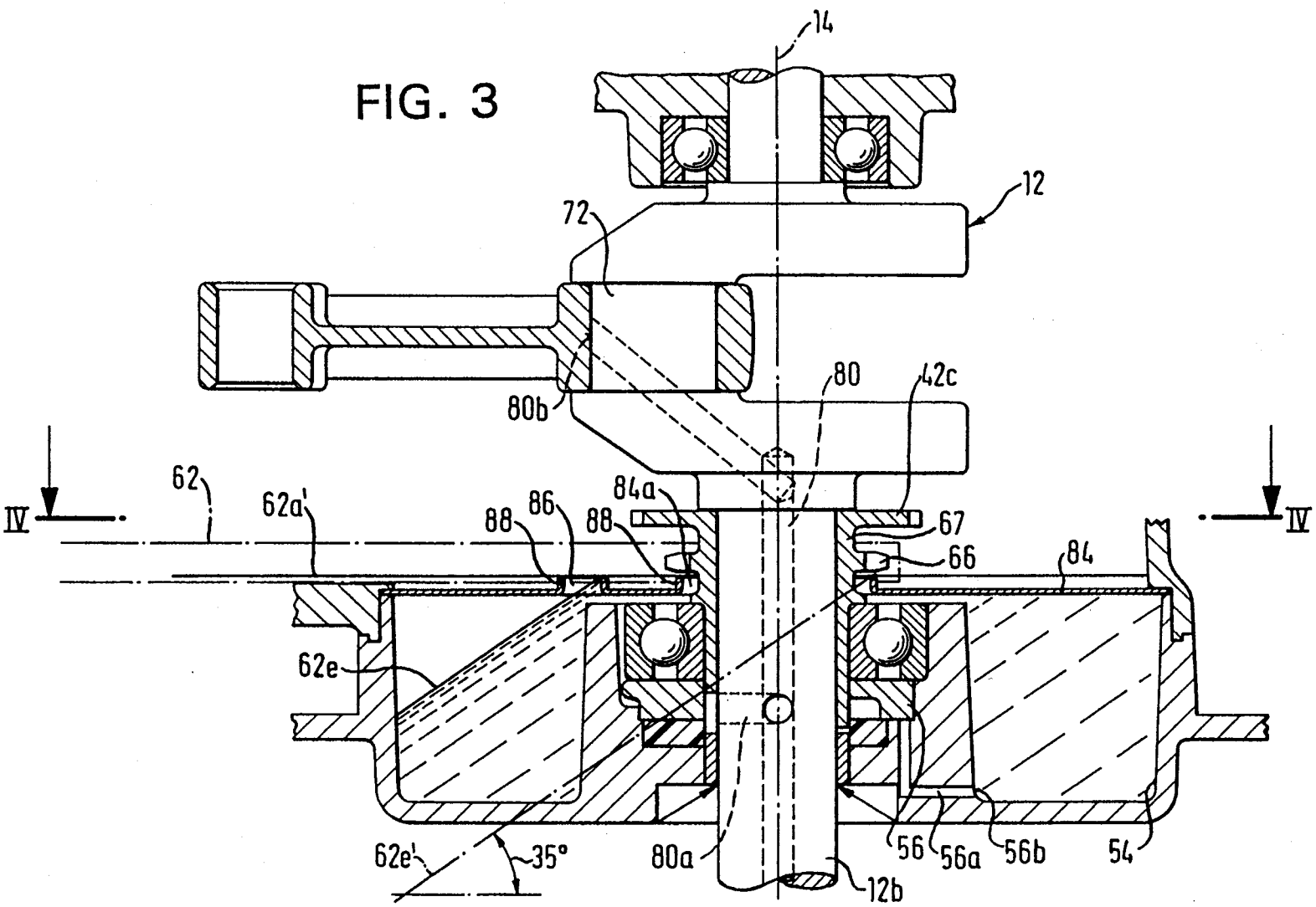
FIG. 3 shows a vertical section in the vicinity of the crankshaft of the internal combustion engine illustrated in FIG. 1 with an oil pump.

For engines which might be subjected to high loads, an additional oil pump 56 could also preferably be used in addition to the embodiment of oil transport as discussed above. As shown in FIG. 3, the pump 56 can preferably receive oil via a feed line 56*a* from the annulus 54. Since the engine must primarily be suitable for an extreme inclination toward the rear (pivoting of the engine around a horizontal axis in the clockwise direction as shown in FIGS. 1 and 3), the mouth 56*b* of the duct 56*a* can preferably be located Ion the side of the crankshaft axis 14 which is diametrically opposite the camshaft 16, or in other words, towards the rear of the engine.

The oil pump 56 can preferably be connected to a passage 80 in the crankshaft 12 by means of a radial tap line 80*a*. The passage 80 in turn can end at the connecting rod bearing 72, forming a discharge hole 80*b*. The bearing which can be subjected to the greatest stress during operation, namely the connecting rod bearing 72, can thus preferably be positively lubricated. The lubrication of the other bearings, i.e. bearings 44, 57, can still preferably be performed by the oil-transporting action of the transmission 60.

To make certain, in the possible inclined positions of the engine, that the connecting rod bearing 72 can still be positively lubricated by means of the oil pump 56, the annulus 54 can preferably be provided with a cover 84 in the model with an oil pump. To maintain the oil circuit which runs through the oil pump 56, the cover 84 does not essentially need to completely close the annulus 54, but can preferably have oil openings, 84*a*, 86, which are designed as a function of the oil transport capacity of the oil pump 56. In many cases, it can be sufficient to have only a central opening 84a in the cover 84, through which the crankshaft 12 runs, which opening 84*a* can preferably be made accordingly larger than the crankshaft 12, so that there can preferably be a slight gap between the cover 84 and the crankshaft 12 (or, between the cover 84 and the bushing 67 with the gear wheels 42*c* and 66).

By providing such a cover 84, an oil supply can essentially be maintained in the annulus 54 even when the engine is inclined downwardly, that is the front end being lower than the back end. Without a cover present, conditions might arise wherein all of the oil would flow to the front of the engine, thereby leaving the opening 56*b* out of the oil. With a cover 84 present, the flow of oil to the front of the engine could be inhibited, and a quantity of oil could be retained in the annulus 54 for the oil pump 56.

Under some alternative conditions, additional openings may be necessary. One such additional oil passage opening 86 could be configured as shown in FIGS. 3 and 4, and could preferably be located on the side of the crankshaft axis 14 facing the camshaft 18, or towards the front of the crankshaft 12. The reason, once again, is that in the severely inclined position, which must be taken into consideration with a cylinder inclined diagonally upward (limit angle 35 degrees, see FIG. 3), the mouth 56*b* of the feed line 56*a* must in all cases be below the surface of the oil bath. The level of this oil bath is set, at least initially, to the level 62*e* illustrated in FIGS. 2 and 3. With a quantity of oil less than that shown in FIG. 2, after a certain length of time, the level 62*e'* indicated in FIG. 3 may possibly be reached, and is defined by the lowest point of the central opening 84*a*. In any case, the opening 56*b* of the feed line 56*a* will generally always remains underneath the surface of the lubricating oil bath.

So that even when the cover 84 is used, there can essentially always be a minimum level of oil (oil level 62*a'* with a vertical crankshaft axis 14), the oil passage openings (central opening 84*a* and opening 86) can each preferably be provided with a circumferential collar 88 which projects upward, which serves as a sort of "overflow". Depending on the inclination of the engine, the chain 62 can therefore generally always transport oil from the oil pool formed on the cover into distant areas of the engine. For this type of lubrication, essentially no additional moving parts are needed, so that reliable operation can be provided with an economical construction.

The small, light, one-cylinder, four-cycle engine described above is suitable for use in machinery, in particular a lawn mower. It is also suitable for use in other types of operations where the inclination of the engine changes.

One feature of the invention resides broadly in the internal combustion engine 10 with a crankshaft 12 which is vertical in the normal position of the engine, at least one overhead camshaft 16 and a transmission 60 between the crankshaft 12 and the at least one camshaft 16, with a plane of movement inside a transmission chamber 70 perpendicular to the axis of the crankshaft 14, characterized by the fact that the transmission chamber 70 is designed as an oil reservoir, so that in the normal position and when the motor is in a tilted position, Whichever is the lowest-lying segment of the transmission 60 is immersed in the oil.

Another feature of the invention resides broadly in the internal combustion engine, characterized by the fact that the transmission 60 is formed by an endless chain 62, which runs over a gear wheel 64 connected to the camshaft 16 and a gear wheel 66 connected to the crankshaft 12.

Yet another feature of the invention resides broadly in the internal combustion engine, characterized by the fact that the transmission is formed by an endless belt, preferably a toothed belt, which runs over a pulley connected to the camshaft and a pulley connected to the crankshaft.

Still another feature of the invention resides broadly in the internal combustion engine, characterized by the fact that in the vicinity of the crankshaft-side end and/or of the camshaft-side end of the transmission 60, there is at least one deflector for oil centrifuged off by the transmission 60 to produce oil splashes or an oil mist.

Yet still another feature of the invention resides broadly in the internal combustion engine, characterized by the fact that in the vicinity of one bearing point of the crankshaft 12 and/or of the camshaft 16, there is at least one oil way to conduct the oil which has settled out of the oil splashes or the oil mist to the corresponding bearing point.

Another feature of the invention resides broadly in the internal combustion engine, characterized by an oil pump 56, the intake of which is connected to the oil reservoir, and the outlet of which is connected to a crankshaft connecting rod bearing 72.

Still another feature of the invention resides broadly in the internal combustion engine, characterized by the fact that the outlet of the oil pump 56 is connected to a passage 80 in the crankshaft 12 with a discharge hole **80*b* on the connecting rod bearing 72**.

Yet another feature of the invention resides broadly in the internal combustion engine, characterized by, the fact that the oil pump 56 is a rubber vane pump driven by the crankshaft 12.

Still yet another feature of the invention resides broadly in the internal combustion engine, characterized by the fact that part of the oil reservoir is an annulus 54 which surrounds the crankshaft 12.

Another feature of the invention resides broadly in the internal combustion engine, characterized by the fact that the intake of the oil pump 56 is connected by means of a feed line **56*a* to the annulus 54, which empties into the annulus 54** in the vicinity of the bottom of the annulus.

Still another feature of the invention resides broadly in the internal combustion engine, characterized by the fact that the feed line **56*a* into the annulus 54 empties on the side of the crankshaft axis 14 diametrically opposite the camshaft 16**.

Yet another feature of the invention resides broadly in the internal combustion engine, characterized by the fact that the annulus 54 is equipped with a cover 84 located underneath the transmission 60.

Another feature of the invention resides broadly in the internal combustion engine, characterized by the fact that the cover 84 has at least one oil passage opening 86.

Still yet another feature of the invention resides broadly in the internal combustion engine, characterized by the fact that the at least one oil passage opening 86 has a surrounding collar 88 which projects upward.

Yet still another feature of the invention resides broadly in the internal combustion engine, characterized by the fact that the cover has a central hole **84*a* through which the crankshaft 12** runs.

Another feature of the invention resides broadly in the internal combustion engine, characterized by at least one oil passage opening 86 on the side of the crankshaft axis 14 facing the at least one camshaft 16.

Still another feature of the invention resides broadly in the internal combustion engine, characterized by the fact that the cover 84 is formed by a cover plate.

Yet another feature of the invention resides broadly in the internal combustion engine according to one of the preceding claims, characterized by the fact that part of the oil reservoir is a recess 76 below the camshaft 16.

Still yet another feature of the invention resides broadly in the use of the internal combustion engine in a lawn mower.

Some examples of lawn mowers and small one cylinder, four cycle engines and the components thereof, which could possibly be used in the context of the present invention are disclosed by the following U.S. Pat. Nos. 4,510,739 to Kurt Dluhosch, entitled "Lawn Mower"; 5,146,735 to Orville McDonner, entitled "Lawn Mower Drive and Control Systems"; 5,155,985 to Oshima et al., entitled "Working Vehicle Controllable by Walking Operator and Having Independently Driven Right and Left Ground Wheels"; 5,159,803 to Gilbert Earley, entitled "Edging and Trimming Mechanism for use with a Power Lawn Mower"; 5,190,019 to Arthur Harvey, entitled "Interlock Circuit for De-Activating an Engine"; as well as the following: U.S. Pat. Nos. 4,711,077 to Katsukake et al.; 4,688,529 to Mitadera et al.; 4,573,436 to Owens; 4,570,587 to Watanabe et al.; and 4,570,584 to Uetsuji et al.

In addition, fly-wheel units which could possibly also be used in the context of the present invention are disclosed by U.S. Pat. No. 4,813,295 to Drexl et al., entitled "Fly-Wheel Unit with Disengagable Friction Clutch"; and U.S. Pat. No. 4,782,718 to Hartig et al., entitled "Fly-Wheel Unit for an Internal-Combustion Engine".

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 12 497, filed on Apr. 16, 1993, having inventors Klaus LÜck, Paul Kehl and Detlef Nonnenberg, and DE-OS P 43 12 497 and DE-PS P 43 12 497, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. An internal combustion engine for powering a device, said internal combustion engine comprising:

crankshaft means rotatable about an axis, said crankshaft means being configured for outputting power generated by said internal combustion engine;

at least one cylinder, said at least one cylinder having a first end and a second end;

said crankshaft means being disposed adjacent said first end of said cylinder;

piston means disposed within said at least one cylinder and pivotably connected to said crankshaft means to rotate said crankshaft means;

valve means disposed adjacent said second end of said cylinder, said valve means being configured for introducing fuel and air into said at least one cylinder, and exhausting exhaust gases out of said at least one cylinder;

camshaft means disposed adjacent said valve means for operating said valve means;

camshaft transmission means connected between said camshaft means and said crankshaft means for operating said camshaft means with said crankshaft means, said camshaft transmission means defining a first plane;

said engine being configured for being operated with said first plane principally disposed substantially horizontally;

chamber means for housing said camshaft transmission means, said chamber means comprising oil reservoir means configured for containing a quantity of oil therein; and said chamber means comprising means for maintaining at least a portion of said camshaft transmission means immersed in the oil during operation of said engine with said first plane disposed at substantially any angle between and including substantially horizontal to a substantial angle with respect to horizontal.

2. A lawn mower comprising:

blade means;

housing means for containing said blade means therewithin;

wheel means for supporting said housing means above a surface to be mowed;

the lawn mower defining a first plane substantially parallel to the surface to be mowed;

handle means extending from said housing means for guiding said housing means along the surface;

an internal combustion engine mounted to said housing means, said internal combustion engine comprising:

crankshaft means rotatable about an axis and connected to said blade means for operating said blade means;

at least one cylinder, said at least one cylinder having a first end and a second end;

said crankshaft means being disposed adjacent said first end of said cylinder;

piston means disposed within said at least one cylinder and pivotably connected to said crankshaft means to rotate said crankshaft means;

valve means disposed adjacent said second end of said cylinder, said valve means being configured for introducing fuel and air into said at least one cylinder, and exhausting exhaust gases out of said at least one cylinder;

camshaft means for operating said valve means;

camshaft transmission means connected between said camshaft means and said crankshaft means for operating said camshaft means with said crankshaft means;

chamber means for housing said camshaft transmission means, said chamber means comprising oil reservoir means configured for containing a quantity of oil therein; and said chamber means comprising means for maintaining at least a portion of said camshaft transmission means immersed in the oil during operation of said lawn mower with said first plane disposed at an angle between and including substantially horizontal to a substantial angle with respect to horizontal.

3. The lawn mower according to claim 1, wherein:

the lawn mower is configured for being operated with said first plane principally disposed substantially horizontally with the crankshaft means disposed substantially vertically;

said camshaft means comprises an overhead camshaft disposed adjacent the second end of said cylinder;

said camshaft transmission means defines a plane of movement; and the plane of movement of said camshaft transmission means is disposed substantially parallel to said first plane of the lawn mower.

4. The lawn mower according to claim 3, wherein:

each of said camshaft means and said crankshaft means comprises a gear wheel; and said camshaft transmission means comprises an endless chain disposed about said gear wheel of each of said camshaft means and said crankshaft means.

5. The lawn mower according to claim 4, wherein:

said chamber means has a first end disposed spaced apart from the first end of said at least one cylinder with said crankshaft means disposed between the first end of said at least one cylinder and the first end of said chamber means, and a second end disposed spaced apart from the second end of said at least one cylinder with said camshaft means disposed between the second end of said at least one cylinder and the second end of said chamber means;

at least one of said first and second ends of said chamber means comprises deflector means for oil centrifugally thrown off by said transmission means; and said deflector means being configured for dissipating oil thrown off by said transmission means into an oil mist.

6. The lawn mower according to claim 5, wherein:

at least one of the crankshaft means and the camshaft means comprises a bearing surface; and said internal combustion engine comprises at least one oil passage for carrying the oil mist to a corresponding bearing surface.

7. The lawn mower according to claim 6, further comprising:

connecting rod means pivotably connecting said crankshaft means to said piston means;

bearing means disposed between said connecting rod means and said crankshaft means; and an oil pump for conducting oil to said bearing means, said oil pump having an oil intake disposed in the oil reservoir, and an oil outlet disposed adjacent said bearing means.

8. The lawn mower according to claim 7, wherein: said crankshaft means comprises oil passage means disposed therewithin connecting said oil pump to said oil outlet adjacent said bearing means.

9. The lawn mower according to claim 8, wherein said oil pump comprises a rubber vane pump driven by the crankshaft.

10. The lawn mower according to claim 9, wherein said crankshaft means has a base portion extending out of said internal combustion engine, and at least a portion of said chamber means comprises an annulus disposed about the base portion of said crankshaft means.

11. The lawn mower according to claims 10, wherein the annulus has a top portion disposed vertically above a bottom thereof, and said intake of said oil pump is disposed within the annulus adjacent the bottom thereof.

12. The lawn mower according to claim 11, wherein: the annulus has a first side disposed towards said camshaft means and a second side diametrically opposite to said camshaft means; and said intake of said oil pump is located on the second side of said annulus.

13. The lawn mower according to claim 12, further comprising cover means disposed at the top of the annulus, between the annulus and said camshaft transmission.

14. The lawn mower according to claim 13, wherein said cover means comprises at least one oil passage opening therethrough.

15. The lawn mower according to claim 14, wherein: the at least one oil passage opening has a surrounding collar disposed therearound and projecting vertically upwards away from said cover means.

16. The lawn mower according to claim 15, wherein the at least one oil passage comprises a central opening of said cover means through which said crankshaft means is disposed.

17. The lawn mower according to claim 16, wherein the at least one oil passage opening comprises at least one additional oil passage opening towards the first side of said annulus facing said camshaft means.

18. The lawn mower according to claim 17, wherein: said cover means is formed by a cover plate; and at least a portion of said chamber means comprises an additional recess disposed below the camshaft.

19. A method of manufacturing and operating a lawn mower comprising: blade means; housing means for containing said blade means therewithin; wheel means for supporting said housing means above a surface to be mowed; the lawn mower defining a first plane substantially parallel to the surface to be mowed; handle means extending from said housing means for guiding said housing means along the surface; an internal combustion engine mounted to said housing means, said internal combustion engine comprising: crankshaft means rotatable about an axis and connected to said blade means for operating said blade means; at least one cylinder, said at least one cylinder having a first end and a second end; said crankshaft means being disposed adjacent said first end of said at least one cylinder; piston means disposed within said at least one cylinder and pivotably connected to said crankshaft means to rotate said crankshaft means; valve means disposed adjacent said second end of said at least one cylinder, said valve means being configured for introducing fuel and air into said at least one cylinder, and exhausting exhaust gases out of said at least one cylinder; camshaft means for operating said valve means; camshaft transmission means connected between said camshaft means and said crankshaft means for operating said camshaft means with said crankshaft means; chamber means for housing said camshaft transmission means, said chamber means comprising oil reservoir means configured for containing a quantity of oil therein; and said chamber means comprising means for maintaining at least a portion of said camshaft transmission means immersed in the oil during operation of said lawn mower with said first plane disposed at an angle between and including substantially horizontal to a substantial angle with respect to horizontal, said method comprising the steps of:

providing the internal combustion engine, housing means, wheel means, handle means and blade means;

fastening the wheel means to the housing means;

fastening the handle means to the housing means;

mounting the internal combustion engine to the housing means;

fastening the blade means to crankshaft means of the internal combustion engine;

starting the internal combustion engine;

rotating the crankshaft to operate said camshaft transmission means;

operating said camshaft transmission means to rotate said camshaft;

rotating said camshaft to operate the valve means;

operating the valve means to exhaust said at least one cylinder and introduce fuel and air into said at least one cylinder;

igniting the fuel in said at least one cylinder to form exhaust gases and produce a force for moving the piston means within said at least one cylinder in a direction away from the second end of said at least one cylinder;

moving the piston means within said at least one cylinder in a direction away from the second end of said at least one cylinder to rotate the crankshaft to rotate the blade means;

moving the lawn mower on the surface to be mowed with the first plane of the lawn mower parallel to the surface to be mowed;

varying the angle of the first plane with respect to the horizontal within a range of angles between and including substantially horizontal to a substantial angle with respect to horizontal, during said moving of the lawn mower; and maintaining at least a portion of said camshaft transmission means immersed in the oil during operation of said lawn mower with said first plane disposed at an angle between and including substantially horizontal to a substantial angle with respect to horizontal.

* * * * *

UNITED STATES PATENT AND TRADEMARK OFFICE

CERTIFICATE OF CORRECTION

PATENT NO. : 5,447,127

DATED : September 5, 1995

INVENTOR(S) : Klaus LÜCK, Paul KEHL and Detlef NONNENBERG

It is certified that error appears in the above-indentified patent and that said Letters Patent is hereby corrected as shown below:

In column 13, line 43, after 'located', delete "Ion" and insert --on--.

Signed and Sealed this

Nineteenth Day of November, 1996

Bruce Lehman

*Attest:*

BRUCE LEHMAN

*Attesting Officer*

*Commissioner of Patents and Trademarks*